US006315682B1

(12) United States Patent
Iwami et al.

(10) Patent No.: US 6,315,682 B1
(45) Date of Patent: Nov. 13, 2001

(54) MULTI-PIECE SOLID GOLF BALL

(75) Inventors: Satoshi Iwami; Keiji Moriyama; Kazunari Yoshida; Keiji Ohama, all of Akashi (JP)

(73) Assignee: Sumitomo Rubber Industries, Ltd., Hyogen-ken (JP)

( * ) Notice: Subject to any disclaimer, the term of this patent is extended or adjusted under 35 U.S.C. 154(b) by 0 days.

(21) Appl. No.: 09/570,379

(22) Filed: May 12, 2000

(30) Foreign Application Priority Data

May 12, 1999 (JP) ..... 11-131250

(51) Int. Cl.[7] ..... A63B 37/04; A63B 37/06; A63B 37/08

(52) U.S. Cl. ..... 473/374; 473/373; 473/371; 473/370

(58) Field of Search ..... 473/371, 373, 473/374, 376, 377

(56) References Cited

U.S. PATENT DOCUMENTS 5,830,085 * 11/1998 Higuchi et al. ..... 473/373
5,876,294 * 3/1999 Yamagishi et al. ..... 473/374
5,935,022 * 8/1999 Sugimoto et al. ..... 473/373
6,071,201 * 6/2000 Maruko ..... 473/373
6,190,269 * 2/2001 Moriyama ..... 473/373

FOREIGN PATENT DOCUMENTS

A9313643 12/1997 (JP) .

* cited by examiner

*Primary Examiner*—Jeanette Chapman
*Assistant Examiner*—Alvin A. Hunter, Jr.
(74) *Attorney, Agent, or Firm*—Birch, Stewart, Kolasch & Birch, LLP

(57) ABSTRACT

A multi-piece solid golf ball having very soft and good shot feel at the time of hitting, and having excellent flight performance by accomplishing high rebound characteristics and high launch angle when hit by a driver and an iron club. The solid golf ball includes a core, an intermediate layer formed on the core, and a cover covering the core, wherein the intermediate layer (a) is formed from a rubber composition containing a base rubber, a co-crosslinking agent, an organic peroxide and a filler, (b) has a hardness in JIS-C hardness of 75 to 90, and the hardness of the intermediate layer is higher than a surface hardness in JIS-C hardness of the center by 1 to 12, (c) has a thickness of 0.2 to 1.3 mm, and (d) has a specific gravity of 1.20 to 1.60.

6 Claims, 2 Drawing Sheets

MULTI-PIECE SOLID GOLF BALL

FIELD OF THE INVENTION

The present invention relates to a multi-piece solid golf ball. More particularly, it relates to a multi-piece solid golf ball having a very soft and good shot feel at the time of hitting, and having excellent flight performance by accomplishing high rebound characteristics and high launch angle when hit by a driver or an iron club.

BACKGROUND OF THE INVENTION

In the history of golf balls, a thread wound golf ball was firstly developed. The thread wound golf ball is obtained by winding thread rubber in a stretched state on a solid or liquid center to form a thread wound core and covering it with a cover of balata, etc. having a thickness of 1 to 2 mm.

A two-piece solid golf ball was subsequently developed, which was composed of a core formed from integrally molded rubber material and a thermoplastic resin cover (e.g. ionomer resin cover) formed on the core. The two-piece solid golf ball is easily produced because of its simple structure, and it has excellent rebound characteristics and excellent durability. Therefore, the two-piece solid golf ball is generally approved of and employed by many golfers, mainly amateur golfers. However, the two-piece solid golf ball exhibits a harder and poorer shot feel at the time of hitting than the thread wound golf ball.

wherein the center point of the core, the surface of the core, the intermediate layer and the cover have a higher hardness which increases in this order, is described in Japanese Patent Kokai publication No. 313643/1997. It is also described that the golf ball has excellent flight performance and durability, and good shot feel. However, in such a golf ball, there has been problems in that the rebound characteristics are degraded and the shot feel is hard and poor, because the intermediate layer is formed from a thermoplastic resin.

In order to provide a two-piece solid golf ball having a shot feel as good as the thread wound golf ball, a soft type two-piece solid golf ball using a softer core has been proposed. However, the use of the soft core adversely affects on rebound characteristics, resulting in a reduction in flight distance and a deterioration in durability.

It has been proposed to place an intermediate layer between the core and the cover of the two-piece solid golf ball to form a three-piece solid golf ball so as to maintain the balance between flight performance and shot feel at the time of hitting (for example, in Japanese Patent Kokai publication Nos. 313643/1997). The three-piece solid golf ball generally occupies the greater part of the golf ball market. The three-piece solid golf ball, when compared with the two-piece golf ball, has better shot feel while maintaining excellent flight performance, because the three-piece golf ball can provide a variety of hardness distribution.

Three-piece solid golf ball comprising a solid core, an intermediate layer and a cover and having a hardness distribution, wherein the center point of the core, the intermediate layer and the cover have higher hardness which increases in this order, is described in Japanese Patent Kokai publication No. 313643/1997. It is also described that the golf ball has excellent flight performance and durability, and good shot feel. However, in the golf ball, there have been problems that the rebound characteristics are degraded and the shot feel is hard and poor, because the intermediate layer is formed from a thermoplastic resin.

A golf ball having such performances has not been obtained in view of the balance of flight performance and shot feel. Therefore, it is required to provide a golf ball having longer flight distance and better shot feel.

OBJECTS OF THE INVENTION

A main object of the present invention is to provide a multi-piece solid golf ball having soft and good shot feel at the time of hitting, and having excellent flight performance when hit by a driver or an iron club by providing high rebound characteristics and high launch angle.

According to the present invention, the object described above has been accomplished, in a multi-piece solid golf ball comprising a core consisting of a center and an intermediate layer formed on the center, and a cover covering the core, by forming the intermediate layer from a thermoplastic resin, and adjusting the hardness, thickness and specific gravity of the intermediate layer and the hardness distribution of the core to a specified range, thereby providing a multi-piece solid golf ball having a soft and good shot feel at the time of hitting, and having excellent flight performance by accomplishing high rebound characteristics and high launch angle when hit by a driver or an iron club.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising a core consisting of a center and an intermediate layer formed on the center, and a cover covering the core, wherein the intermediate layer (a) is formed from a rubber composition comprising a base rubber, a co-crosslinking agent, an organic peroxide and a filler, (b) has a hardness in JIS-C hardness of 75 to 90, and the hardness of the intermediate layer is higher than a surface hardness in JIS-C hardness of the center by 1 to 12, (c) has a thickness of 0.2 to 1.3 mm, and (d) has a specific gravity of 1.20 to 1.60. In order to practice the present invention suitably, it is preferable that the cover have a thickness of 1.0 to 3.0 mm and a Shore D hardness of 58 to 75, the intermediate layer have a specific gravity of 1.25 to 1.50, the specific gravity of the intermediate layer being higher than that of the center by 0.1 to 0.4, and the intermediate layer has a thickness of 0.2 to 0.9 mm.

In the golf ball of the present invention, the launch angle is large by placing a thin rubber layer at an intermediate layer, and the rebound characteristics are improved by heightening the hardness of the intermediate layer. Therefore, the flight distance is extended, and the shot feel is soft and good. In addition, the specific gravity of the center can be low by increasing the specific gravity of the intermediate layer, and thus the weight ratio of the rubber component in the center can be large. Therefore, the rebound characteristics of the center are improved and the inertia of moment of the golf ball is large, and thus the spin amount immediately after hitting is small, and the spin amount is not reduced and the retention of the spin amount is large after the golf ball passes the highest point of the flight curve of the golf ball, which extends the flight distance.

DETAILED DESCRIPTION OF THE INVENTION

Figure 1:
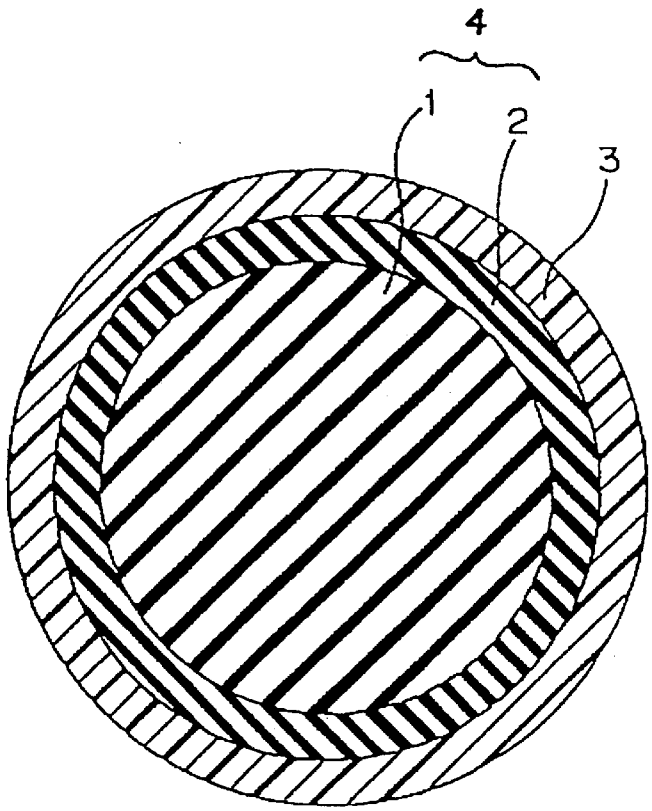
FIG. 1 is a schematic cross section illustrating one embodiment of the golf ball of the present invention.

The multi-piece solid golf ball is the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of a center 1 and an intermediate layer 2 formed on the center 1, and a cover 3 covering the core 4. In the golf ball of the present invention, the cover 3 may be a single-layer structure or a multi-layer structure, which has two or more layers. However, in order to simply explain the golf ball of the present invention, a golf ball having one layer of cover 3, that is, a three-piece solid golf ball, will be used hereinafter for explanation.

The core 4, including both the center 1 and the intermediate layer 2, is obtained by press-molding a rubber composition. The rubber composition essentially contains a base rubber, a co-crosslinking agent, an organic peroxide and a filler.

The base rubber used for the core 4 of the present invention may be natural rubber or synthetic rubber, which has been conventionally used for cores of solid golf balls. Preferred is a high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) or the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and α,β-unsaturated carboxylic ester and the like. The preferred co-crosslinking agent for the center is zinc acrylate because it imparts high rebound characteristics to the resulting golf ball, and the preferred co-crosslinking agent for the intermediate layer is magnesium methacrylate because it imparts good redeemability from a mold to the core. The amount of the co-crosslinking agent is from 15 to 40 parts by weight, preferably from 20 to 35 parts by weight, more preferably from 25 to 30 parts by weight in the center, and from 25 to 55 parts by weight, preferably from 30 to 50 parts by weight, more preferably from 35 to 50 parts by weight in the intermediate layer, based on 100 parts by weight of the base rubber. When the amount of the co-crosslinking agent is larger than 40 parts by weight in the center and 55 parts by weight in the intermediate layer, the core is too hard, and the shot feel is poor. on the other hand, when the amount of the co-crosslinking agent is smaller than 15 parts by weight in the center and 25 parts by weight in the intermediate layer, it is required to increase an amount of the organic peroxide in order to impart a desired hardness to the core. Therefore, the rebound characteristics are degraded.

It is required to employ the blend of the metal salt of unsaturated carboxylic acid and α,β-unsaturated carboxylic ester as a co-crosslinking agent particularly in the intermediate layer 2 in order to obtain the desired hardness. Examples of α,β-unsaturated carboxylic ester include methyl, ethyl, or propyl esters of α,β-unsaturated carboxylic acids having 3 to 8 carbon atoms (e.g. acrylic acid, methacrylic acid, etc.), trimethylolpropane triacrylate and the like. Preferred is trimethylolpropane triacrylate. The amount of the co-crosslinking agent is from 5 to 40 parts by weight, preferably from 10 to 30 parts by weight, more preferably from 15 to 25 parts by weight, based on 100 parts by weight of the base rubber. When the amount of the co-crosslinking agent is smaller than 5 parts by weight, the rebound characteristics are degraded. On the other hand, when the amount of the co-crosslinking agent is larger than 40 parts by weight, the core is too hard, and the shot feel is poor. It can be accomplished to heighten the core hardness easily and to vulcanize the core at lower temperature.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.1 to 3.0 parts by weight, preferably 0.3 to 2.5 parts by weight, preferably 0.5 to 2.0 parts by weight, based on 100 parts by weight of the base rubber. When the amount of the organic peroxide is smaller than 0.1 parts by weight, the core is too soft, and the rebound characteristics are degraded, which reduces the flight distance. On the other hand, when the amount of the organic peroxide is larger than 3.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, an inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is from 10 to 50 parts by weight, preferably from 15 to 49 parts by weight, based on 100 parts by weight of the base rubber. When the amount of the filler is smaller than 10 parts by weight, it is difficult to adjust the weight of the resulting golf ball. On the other hand, when the amount of the filler is larger than 50 parts by weight, the weight ratio of the rubber component in the core is small, and the rebound characteristics reduce too much. It is preferable to employ the high specific gravity metal powder filler such as tungsten powder as a specific gravity adjuster in the intermediate layer in order to obtain the desired specific gravity.

The rubber compositions for the center and intermediate layer of the golf ball of the present invention can contain other components, which have been conventionally used for preparing the core of solid golf balls, such as antioxidant or peptizing agent or organic sulfide compound (e.g. diphenyl disulfide or derivatives thereof). If used, the amount of the organic sulfide compound is 0.05 to 3.0 parts by weight, preferably 0.3 to 2.0 parts by weight, more preferably 0.5 to 1.0 parts by weight, based on 100 parts by weight of the base rubber. When the amount of the organic sulfide compound is smaller than 0.05 parts by weight, the technical effects accomplished by the presence of the organic sulfide compound are not be sufficiently obtained. On the other hand, when the amount of the organic sulfide compound is larger than 3.0 parts by weight, the technical effects are not improved more. If used, the amount of the antioxidant is preferably 0.1 to 1.0 parts by weight, and that of the peptizing agent is preferably 0.1 to 5.0 parts by weight, based on 100 parts by weight of the base rubber.

Figure 2:
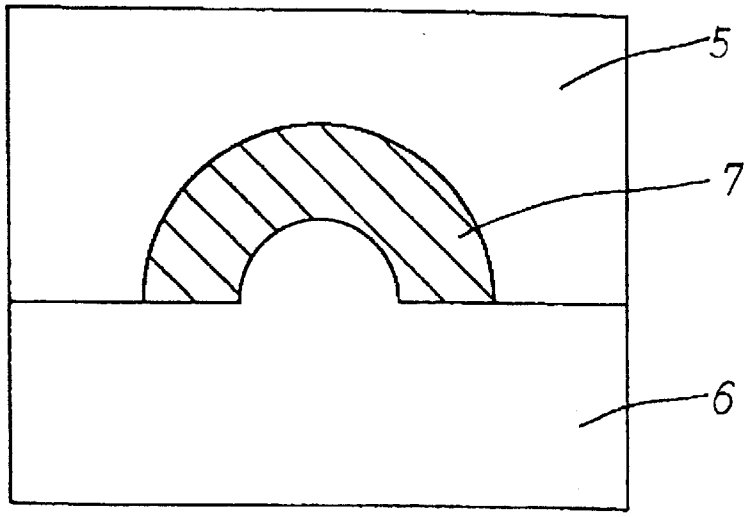
FIG. 2 is a schematic cross section illustrating one embodiment of a mold for molding an intermediate layer of the golf ball of the present invention.
Figure 3:
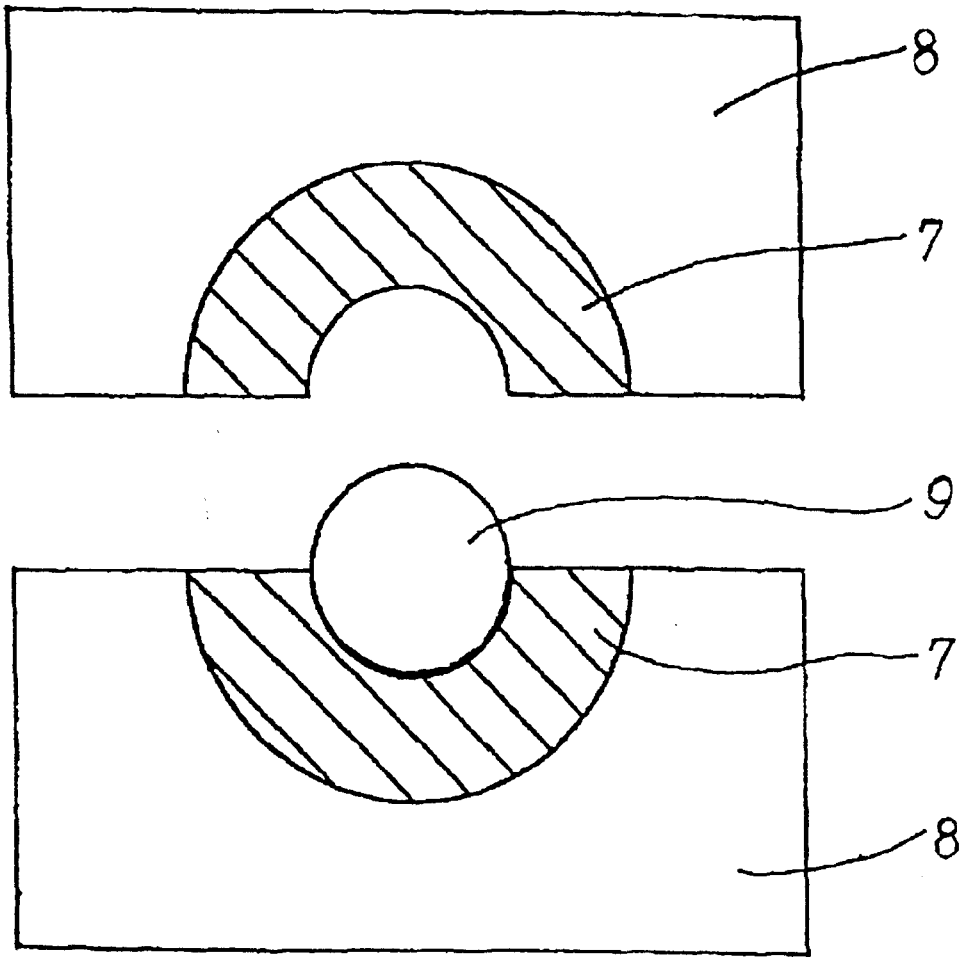
FIG. 3 is a schematic cross section illustrating one embodiment of a mold for molding a core of the golf ball of the present invention.

The process of producing the core of the golf ball of the present invention will be explained with reference to FIG. 2 and FIG. 3. FIG. 2 is a schematic cross section illustrating one embodiment of a mold for molding an intermediate layer of the golf ball of the present invention. FIG. 3 is a schematic cross section illustrating one embodiment of a mold for molding a core of the golf ball of the present invention. The rubber composition for the center is molded by using an extruder to form a cylindrical unvulcanized center. The rubber composition for the intermediate layer is then vulcanized by press-molding, for example, at 120 to 160° C. for 2 to 30 minutes using a mold having a semi-spherical cavity 5 and a male plug mold 6 having a semi-spherical convex having the same shape as the center as described in FIG. 2 to obtain a vulcanized semi-spherical half-shell 7 for the intermediate layer. The unvulcanized center 9 is covered with the two vulcanized semi-spherical half-shells 7 for the intermediate layer, and then vulcanized by integrally press-molding, for example, at 140 to 180° C. for 10 to 60 minutes in a mold 8 for molding a core, which is composed of an upper mold and a lower mold, as described in FIG. 3 to obtain the core 4. The core 4 is composed of the center 1 and the intermediate layer 2 formed on the center. In the process of producing the core of the present invention, the mold contacts with only the intermediate layer during the molding. Therefore the productivity is good by using magnesium methacrylate as a co-crosslinking agent in the rubber composition for the intermediate layer, because it imparts good redeemability from a mold to the core.

In the golf ball of the present invention, the center 1 has a diameter of 30 to 40 mm, preferably 34.2 to 39.4 mm, more preferably 35.6 to 38.6 mm. When the diameter of the center is smaller than 30 mm, it is required to increase the thickness of the intermediate layer or the cover to a thickness more than a desired thickness. Therefore, the rebound characteristics are degraded, or the shot feel is hard and poor. On the other hand, when the diameter of the center is larger than 40 mm, it is required to decrease the thickness of the intermediate layer or the cover to a thickness less than a desired thickness. Therefore the technical effects accomplished by the presence of the intermediate layer are not sufficiently obtained.

In the golf ball of the present invention, it is desired that the center 1 have a surface hardness in JIS-C hardness of 60 to 85, preferably 70 to 84, more preferably 72 to 82. When the hardness is smaller than 60, the shot feel is heavy and poor, and the center is too soft, and the rebound characteristics are degraded, which reduces the flight distance. On the other hand, when the hardness is larger than 85, the center is too hard, and the shot feel is hard and poor.

In the golf ball of the present invention, it is desired that a central point hardness in JIS-C hardness of the center is lower than the surface hardness by 5 to 25, preferably 6 to 20, more preferably 7 to 15. When the hardness difference is smaller than 5, the launch angle is small, which reduces the flight distance. On the other hand, when the hardness difference is larger than 25, the shot feel is heavy and poor, and the rebound characteristics are degraded, which reduces the flight distance. The central point hardness of the center as used herein is determined by measuring a hardness at the central point of the center in section, after the core, which is formed by integrally press-molding the center and the intermediate layer, is cut into two equal parts. The surface hardness of the center as used herein is determined by measuring a hardness at the surface of the center, after removing the intermediate layer 2 from the core to expose the center 1.

In the golf ball of the present invention, it is required that the intermediate layer 2 have a hardness in JIS-C hardness of 75 to 90, preferably 78 to 90, more preferably 80 to 88. When the hardness is smaller than 75, the hardness difference from the cover is large, and the durability is poor. On the other hand, when the hardness is larger than 90, the intermediate layer is too hard, and the shot fell is poor.

In the present invention, it is required that the hardness of the intermediate layer 2 is-higher than the surface hardness of the center 1 by 1 to 12, preferably 2 to 11, more preferably 3 to 10. When the hardness difference is smaller than 1, the hardness difference from the cover is large, and the durability is poor. On the other hand, when the hardness difference is larger than 12, the resulting golf ball is hard, and the launch angle is small. As used herein, the term "a hardness of the intermediate layer" means the surface hardness of the core having a two-layered structure, which is formed by integrally press-molding the center and the intermediate layer.

In the golf ball of the present invention, it is required that the intermediate layer 2 have a specific gravity of 1.20 to 1.60, preferably 1.25 to 1.50, more preferably 1.25 to 1.45, most preferably 1.30 to 1.42. When the specific gravity is smaller than 1.20, it is required to increase that of the center, and the rebound characteristics are degraded. On the other hand, when the specific gravity is larger than 1.60, the weight of the resulting golf ball is too large, because the specific gravity of the center and the cover has the lower limit.

In the golf ball of the present invention, it is desired that the specific gravity of the intermediate layer 2 be higher than that of the center 1 by 0.1 to 0.4, preferably 0.2 to 0.3. When the specific gravity difference is smaller than 0.1, the specific gravity of the center is large, and the rebound characteristics are degraded. On the other hand, when the specific gravity difference is larger than 0.4, the specific gravity of the intermediate layer is large, because the specific gravity of the center has the lower limit, and thus the weight of the resulting golf ball is too large. The amount of the filler in the center can be as small as possible by adjusting the specific gravity of the intermediate layer 2 to the above range, and the weight ratio of the rubber component in the center is large. Therefore the rebound characteristics of the center are improved, and the rebound characteristics of the resulting golf ball are improved.

In the golf ball of the present invention, it is required that the intermediate layer 2 have a thickness of 0.2 to 1.3 mm, preferably 0.2 to 0.9 mm, more preferably 0.3 to 0.8 mm. When the thickness is smaller than 0.2 mm, the technical effects accomplished by the presence of the intermediate layer are not sufficiently obtained, and the shot feel is hard and poor. In addition, the launch angle is small, which reduces the flight distance. On the other hand, when the thickness is larger than 1.3 mm, the intermediate layer is too thick, and the rebound characteristics are degraded. In addition, the launch angle is small, which reduces the flight distance.

In the golf ball of the present invention, the intermediate layer 2 is preferably formed by press-molding the rubber composition as used in the center 1, which essentially contains a base rubber, a co-crosslinking agent, an organic peroxide and a filler. Since the intermediate layer 2, which is not formed from thermoplastic resin, such as ionomer resin, thermoplastic elastomer, diene copolymer and the like, is formed from the press-molded article of the rubber composition, the rebound characteristics are improved. When the intermediate layer is formed from thermoplastic resin, the intermediate layer can be prepared by injection molding. However, it is difficult to prepare the intermediate layer 2 of the present invention by injection molding, because the intermediate layer 2 has a thickness of 0.2 to 1.3 mm, which is very thin.

Since the center 1 and the intermediate layer 2 are formed from the same vulcanized rubber composition, the adhesion between the center 1 and the intermediate layer 2 is excellent, and the durability is improved. Rubber, when compared with resin, has little deterioration of performance at low temperature lower than room temperature as known in the art, and thus the intermediate layer of the present invention formed from the rubber has excellent rebound characteristics at low temperature.

The cover 3 is then covered on the core 4. In the golf ball of the present invention, the cover 3 preferably has single-layer structure, that is, a three-piece solid golf ball, in view of productivity, but the cover may have multi-layer structure, which has two or more layers.

It is desired that the cover 3 have a thickness of 1.0 to 3.0 mm, preferably 1.5 to 2.6 mm, more preferably 1.8 to 2.5 mm. When the thickness is smaller than 1.0 mm, the rebound characteristics are degraded, which reduces the flight distance. On the other hand, when the thickness is larger than 3.0 mm, the shot feel is hard and poor.

In the golf ball of the present invention, it is desired that the cover 3 have a hardness in Shore D of 58 to 75, preferably 63 to 75, more preferably 66 to 75. When the hardness is smaller than 58, the spin amount is large, and the rebound characteristics are degraded, which reduces the flight distance. On the other hand, when the hardness is larger than 75, the shot feel is hard and poor. If the cover has multi-layer structure, which has two or more layers, it is desired that the thickness and hardness of the outmost layer of the cover be within the above range. The cover hardness as used herein is determined using a Shore D hardness meter according to ASTM D-2240, using as a sample a stack of three or more heat and press molded sheets having a thickness of about 2 mm from the cover composition, which had been stored at 23° C. for 2 weeks.

The cover 3 of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin, which is a copolymer of ethylene and (meth)acrylic acid obtained by neutralizing a portion of carboxylic acid groups with metal ion, is not limited, but examples thereof will be shown by a trade name thereof. Examples of the ionomer resin, which is commercially available from Mitsui Du Pont Polychemical Co., Ltd. include Hi-milan 1555 (Na), Hi-milan 1557 (Zn), Hi-milan 1605 (Na), Hi-milan 1706 (Zn), Hi-milan 1707 (Na) and the like. Examples of the ionomer resin, which is commercially available from Du Pont U.S.A., include Surlyn 8945 (Na) and Surlyn 9945 (Zn). Examples of-the ionomer resin, which is commercially available from Exxon Chemical Co., include Iotek 7010 (Zn) and Iotek 8000 (Na) and the like.

The ionomer resin, which is a terpolymer of ethylene, (meth)acrylic acid and α,β-unsaturated carboxylic acid ester obtained by neutralizing a portion of carboxylic acid groups with metal ion, is not limited, but examples thereof will be shown by a trade name thereof. Examples of the ionomer resin, which is commercially available from Mitsui Du Pont Polychemical Co., Ltd. include Hi-milan 1856 (Na), Hi-milan 1855 (Zn) and Hi-milan AM7316 (Zn) and the like. Examples of the ionomer resin, which is commercially available from Du Pont U.S.A., include Surlyn 6320 (Mg), Surlyn AD8265 (Na), Surlyn AD8269 (Na) and the like. These ionomer resins may be used alone or in combination thereof. Incidentally, Na, Zn and Mg, which are described in parentheses after the trade name of the above ionomer resin indicate metal ion species for neutralization.

As the materials suitably used in the cover 3 of the present invention, the above ionomer resin may be used alone, but the ionomer resin may be used in combination with at least one of thermoplastic elastomer, diene block copolymer and the like.

Examples of the thermoplastic elastomers include polyamide thermoplastic elastomer, which is commercially available from Toray Co., Ltd. under the trade name of "Pebax" (such as "Pebax 2533SNOO"); polyester thermoplastic elastomer, which is commercially available from Toray-Do Pont Co., Ltd. under the trade name of "Hytrel" (such as "Hytrel 3548", "Hytrel 4047"); polyurethane elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 parts by weight, the technical effects of absorbing the impact force at the time of hitting accomplishing by using them are not sufficiently obtained. On the other hand, when the amount is larger than 60 parts by weight, the cover is too soft and the rebound characteristics are degraded, or the compatibility with the ionomer resin is degraded and the durability is degraded.

The composition for the cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core, which is covered with the intermediate layer, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

(i) Production of Unvulcanized Center

The rubber compositions for the center having the formulation shown in Table 1 were mixed, and then extruded to obtain cylindrical unvulcanized-plugs.

(ii) Production of Vulcanized Semi-Spherical Half-Shell for the Intermediate Layer The rubber compositions for the intermediate layer having the formulation shown in Table 2 were mixed, and then vulcanized by press-molding at 140° C. for 5 minutes in the mold (5, 6) as described in FIG. 2 to obtain vulcanized semi-spherical half-shells 7 for the intermediate layer.

(iii) Production of Core

The unvulcanized plugs 9 for the center produced in the step (i) were covered with the two vulcanized semi-spherical half-shells 7 for the intermediate layer produced in the step (ii), and then vulcanized by press-molding at 150° C. for 25 minutes and then 165° C. for 8 minutes in the mold 8 as described in FIG. 3 to obtain cores 4 having a two-layered structure. A surface hardness in JIS-C hardness of the resulting core 4 was measured. The results are shown in Table 4 (Examples) and Table 5 (Comparative Examples) as a hardness (JIS-C hardness) of the intermediate layer (c). The diameter, center hardness (a), surface hardness (b) and specific gravity (d) of the center, and the thickness and specific gravity (e) of the intermediate layer were also measured, and the hardness difference (b−a) and (c−b), and the specific gravity difference (e−d) were calculated. The results are shown in the same Tables.

TABLE 1

| | (parts by weight) | | | | |
|---|---|---|---|---|---|
| Center composition | A | B | C | D | E |
| BR-18 *1 | 100 | 100 | 100 | 100 | 100 |
| Zinc acrylate | 25 | 27 | 30 | 25 | 30 |
| Zinc oxide | 19.9 | 19.2 | 17.4 | 25.0 | 30.0 |
| Dicumyl peroxide | 0.6 | 0.6 | 0.6 | 0.6 | 0.6 |
| Diphenyl disulfide | 0.5 | 0.5 | 0.5 | 0.5 | 0.5 |

TABLE 2

| Intermediate layer | (parts by weight) | | | | |
|---|---|---|---|---|---|
| composition | a | b | c | d | e |
| BR-18 *1 | 100 | 100 | — | — | — |
| Magnesium methacrylate | 45.5 | 45.5 | — | — | — |
| Trimethylolpropane triacrylate | 17.8 | 17.8 | — | — | — |
| Magnesium oxide | 23 | 23 | — | — | — |
| Dicumyl peroxide | 2.0 | 2.0 | — | — | — |
| Tungsten | 48.7 | 22.0 | — | — | — |
| Hi-milan 1555 *2 | — | — | 10 | — | — |
| Hi-milan 1557 *3 | — | — | — | 30 | 50 |
| Hi-milan 1605 *4 | — | — | 5 | — | 50 |
| Hi-milan 1707 *5 | — | — | — | 20 | — |
| Hi-milan 1855 *6 | — | — | — | 50 | — |
| Surlyn 6320 *7 | — | — | 85 | — | — |
| Titanium dioxide | — | — | 2 | 2 | 2 |
| Barium sulfate | — | — | 2 | 2 | 2 |

(iv) Preparation of Cover Compositions

The formulation materials showed in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder.

TABLE 3

| | (parts by weight) | | |
|---|---|---|---|
| Cover composition | I | II | III |
| Hi-milan 1557 *3 | — | — | 10 |
| Hi-milan 1605 *4 | 60 | — | 20 |
| Hi-milan 1706 *8 | 40 | — | — |
| Hi-milan 1855 *6 | — | 10 | — |
| Surlyn 8945 *9 | — | 46 | — |
| Surlyn 9945 *10 | — | 37 | — |
| Surlyn 6320 *7 | — | — | 70 |

TABLE 3-continued

| Cover composition | (parts by weight) I | II | III |
|---|---|---|---|
| Pebax 2533SNOO *11 | — | 5 | — |
| Epofriend A1010 *12 | — | 2 | — |

*1: High-cis polybutadiene (trade name "BR-18") available from JSR Co., Ltd. (Content of 1,4-cis-polybutadiene: 96%)
*2: Hi-milan 1555 (trade name), ethylene-methacrylic acid copolymer ionomer resin obtained by neutralizing with sodium ion, manufactured by Mitsui Du Pont Polychemical Co., Ltd., Shore D hardness: 57
*3: Hi-milan 1557 (trade name), ethylene-methacrylic acid copolymer ionomer resin obtained by neutralizing with zinc ion, manufactured by Mitsui Du Pont Polychemical Co., Ltd., Shore D hardness: 57
*4: Hi-milan 1605 (trade name), ethylene-methacrylic acid copolymer ionomer resin obtained by neutralizing with sodium ion, manufactured by Mitsui Du Pont Polychemical Co., Ltd., Shore D hardness: 61
*5: Hi-milan 1707 (trade name), ethylene-methacrylic acid copolymer ionomer resin obtained by neutralizing with zinc ion, manufactured by Mitsui Du Pont Polychemical Co., Ltd., Shore D hardness: 62
*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., Shore D hardness: 54, flexural modulus: 87 MPa
*7: Surlyn 6320 (trade name), ethylene-methacrylic acid copolymer ionomer resin obtained by neutralizing with magnesium ion, manufactured by Du Pont Co., Shore D hardness: 44
*8: Hi-milan 1706 (trade name), ethylene-methacrylic acid copolymer ionomer resin obtained by neutralizing with zinc ion, manufactured by Mitsui Du Pont Polychemical Co., Ltd., Shore D hardness: 60, flexural modulus: 270 MPa
*9: Surlyn 8945 (trade name), ethylene-methacrylic acid copolymer ionomer resin obtained by neutralizing with sodium ion, manufactured by DuPont USA Co., Shore D hardness: 61, flexural modulus: 270 MPa
*10: Surlyn 9945 (trade name), ethylene-methacrylic acid copolymer ionomer resin obtained by neutralizing with zinc ion, manufactured by Du Pont Co., Shore D hardness: 59, flexural modulus: 220 MPa
*11: Pebax 2533SNOO (trade name), polyether amide thermoplastic elastomer, manufactured by Toray Co., Ltd.
*12: Epofriend A1010 (trade name), styrene-butadiene-styrene (SBS) block copolymer with epoxy groups, manufactured by Daicel Chemical Industries, Ltd., JIS-A hardness = 70, styrene/butadiene (weight ratio) = 40/60, content of epoxy = about 1.5 to 1.7% by weight

Examples 1 to 7 and Comparative Examples 1 to 6

The cover composition was covered on the resulting core 4 having two-layered structure by injection molding to form a cover layer 3 having the thickness shown in Tables 4 (Examples) and Table 5 (Comparative Examples). Then, paint was applied on the surface to produce golf ball having a diameter of 42.7 mm. With respect to the resulting golf balls, the deformation amount, coefficient of restitution, launch angle, spin amount, flight distance and shot feel were measured or evaluated. The results are shown in Table 6 (Examples) and Table 7 (Comparative Examples). The test methods are as follows.

Test Method (1) Hardness (i) JIS-C hardness (Core)

The JIS-C hardness was measured with a JIS-C hardness meter according to JIS K 6301.

(ii) Shore D Hardness of Cover

The Shore D hardness of the cover was measured with a Shore D hardness meter according to ASTM D-2240, using a sample of a stack of three or more heat and press molded sheet having a thickness of about 2 mm from the cover composition, which had been stored at 23° C. for 2 weeks.

(2) Deformation Amount

The deformation amount of golf balls was determined by measuring a deformation amount when applying from an initial load of 10 kgf to a final load of 130 kgf on the golf ball.

(3) Coefficient of Restitution

A metal cylinder having weight of 198.4 g struck against the golf ball at the velocity of 35 m/sec, and the velocity of the cylinder and golf ball before and after strike were measured. The coefficient of restitution was calculated from the velocity and the weight of the cylinder and golf ball.

(4) Flight Performance

A No. 1 wood club (W#1, a driver) or No. 5 iron club (I#5) was mounted to a swing robot manufactured by Golf Laboratory Co. and the resulting golf ball was hit at a head speed of 35 m/second or 30 m/second, respectively, the launch angle, spin amount and flight distance were measured. The spin amount was measured by continuously taking a photograph of a mark provided on the hit golf ball using a high-speed camera. As the flight distance, carry that is a distance to the dropping point of the hit golf ball was measured. The measurement was conducted at 12 times for every golf ball (n=12), and the average is shown as the result of the golf ball.

(5) Shot Feel

The shot feel of the resulting golf ball was evaluated by 10 golfers according to practical hitting test using a No. 1 wood club (W#1, a driver). The evaluation criteria are as follows.

Evaluation Criteria

○: Not less than 7 out of 10 golfers felt that the golf ball has low impact force, and light and good shot feel.

Δ: From 4 to 6 out of 10 golfers felt that the golf ball has low impact force, and light and good shot feel.

x: Not more than 3 out of 10 golfers felt that the golf ball has low impact force, and light and good shot feel.

TABLE 4

| Test item | Example No. 1 | 2 | 3 | 4 | 5 | 6 | 7 |
|---|---|---|---|---|---|---|---|
| Center | | | | | | | |
| Composition | A | A | A | A | B | C | A |
| Diameter (mm) | 35.5 | 36.5 | 37.1 | 37.5 | 36.5 | 36.5 | 37.3 |
| Hardness (JIS-C hardness) | | | | | | | |
| Central point hardness (a) | 68 | 68 | 68 | 68 | 69 | 71 | 68 |
| Surface hardness | 78 | 78 | 78 | 78 | 79 | 81 | 78 |
| Hardness difference (b–a) | 10 | 10 | 10 | 10 | 10 | 1.0 | 1.0 |
| Specific gravity (d) | 1.14 | 1.14 | 1.14 | 1.14 | 1.14 | 1.14 | 1.14 |
| Intermediate layer | | | | | | | |
| Composition | a | a | a | a | a | a | a |
| Thickness (mm) | 1.3 | 0.8 | 0.5 | 0.3 | 0.8 | 0.8 | 0.8 |
| Hardness (c) (JIS-C hardness) | 89 | 85 | 82 | 80 | 84 | 86 | 89 |
| Hardness difference (c–b) | 12 | 7 | 4 | 2 | 10 | 5 | 11 |
| Specific gravity (e) | 1.34 | 1.34 | 1.34 | 1.34 | 1.34 | 1.34 | 1.34 |
| Specific gravity difference (e–d) | 0.2 | 0.2 | 0.2 | 0.2 | 0.2 | 0.2 | 0.2 |
| Cover | | | | | | | |
| Composition | I | I | I | I | I | I | II |
| Thickness (mm) | 2.3 | 2.3 | 2.3 | 2.3 | 2.3 | 2.3 | 1.9 |
| Shore D hardness | 70 | 70 | 70 | 70 | 70 | 70 | 66 |

TABLE 5

| Test item | Comparative Example No. 1 | 2 | 3 | 4 | 5 | 6 |
|---|---|---|---|---|---|---|
| Center | | | | | | |
| Composition | A | A | D | E | E | E |
| Diameter (mm) | 34.2 | 34.2 | 36.5 | 35.0 | 35.0 | 35.0 |
| Hardness (JIS-C hardness) | | | | | | |
| Central point hardness (a) | 68 | 68 | 68 | 71 | 71 | 71 |
| Surface hardness | 78 | 78 | 78 | 81 | 81 | 81 |
| Hardness difference (b–a) | 10 | 10 | 10 | 10 | 10 | 10 |
| Specific gravity (d) | 1.14 | 1.14 | 1.16 | 1.21 | 1.21 | 1.21 |
| Intermediate layer | | | | | | |
| Composition | a | a | b | c | d | e |
| Thickness (mm) | 2.0 | 0.8 | 0.8 | 1.6 | 1.6 | 1.6 |
| Hardness (c) (JIS-C hardness) | 91 | 85 | 85 | 72 | 94 | 86 |
| Hardness difference (c–b) | 16 | 7 | 7 | −9 | 13 | 5 |
| Specific gravity (e) | 1.34 | 1.34 | 1.19 | 0.98 | 0.98 | 0.98 |
| Specific gravity difference (e–d) | 0.2 | 0.2 | 0.03 | −0.23 | −0.23 | −0.23 |
| Cover | | | | | | |
| Composition | I | III | I | I | I | I |
| Thickness (mm) | 2.3 | 2.3 | 2.3 | 2.3 | 2.3 | 2.3 |
| Shore D hardness | 70 | 55 | 70 | 70 | 70 | 70 |

TABLE 6

| Test item | Example No. 1 | 2 | 3 | 4 | 5 | 6 | 7 |
|---|---|---|---|---|---|---|---|
| Deformation amount (mm) | 2.98 | 3.12 | 3.16 | 3.19 | 2.92 | 2.69 | 3.25 |
| Coefficient of restitution | 0.836 | 0.837 | 0.838 | 0.839 | 0.836 | 0.831 | 0.835 |
| Flight performance (W#1, 35 m/sec) | | | | | | | |
| Launch angle (degree) | 14.0 | 14.1 | 14.2 | 14.3 | 14.1 | 14.0 | 14.2 |
| Spin amount (rpm) | 2900 | 2850 | 2830 | 2800 | 2920 | 2990 | 2830 |
| Carry (yard) | 163 | 164 | 164 | 165 | 163 | 162 | 163 |
| Flight performance (I#5, 30 m/sec) | | | | | | | |
| Launch angle (degree) | 17.1 | 17.4 | 17.5 | 17.6 | 17.3 | 17.1 | 17.6 |
| Spin amount (rpm) | 3750 | 3600 | 3600 | 3580 | 3680 | 3800 | 3400 |
| Carry (yard) | 131 | 133 | 133 | 134 | 133 | 131 | 135 |
| Shot feel | ○ | ○ | ○ | ○ | ○ | ○ | ○ |

TABLE 7

| Test item | Comparative Example No. 1 | 2 | 3 | 4 | 5 | 6 |
|---|---|---|---|---|---|---|
| Deformation amount (mm) | 2.75 | 3.41 | 3.05 | 2.74 | 2.60 | 2.68 |
| Coefficient of restitution | 0.833 | 0.822 | 0.826 | 0.821 | 0.823 | 0.822 |
| Flight performance (W#1, 35 m/sec) | | | | | | |
| Launch angle (degree) | 13.8 | 14.0 | 14.0 | 13.9 | 13.7 | 13.8 |
| Spin amount (rpm) | 3000 | 3100 | 2890 | 2900 | 3020 | 2950 |
| Carry (yard) | 159 | 157 | 160 | 158 | 159 | 159 |
| Flight performance (I#5, 30 m/sec) | | | | | | |
| Launch angle (degree) | 16.9 | 17.1 | 17.0 | 16.9 | 16.8 | 16.9 |
| Spin amount (rpm) | 3850 | 3900 | 3700 | 3700 | 3900 | 3700 |
| Flight distance (yard) | 129 | 127 | 129 | 127 | 128 | 128 |
| Shot feel | Δ | x | ○ | x | x | Δ |

As is apparent from the results of Tables 4 to 7, the golf balls of the present invention of Examples 1 to 7, which comprise the intermediate layer of rubber composition, and adjust a hardness, thickness and specific gravity of the intermediate layer, and hardness distribution of the core to a specified range, have very soft and good shot feel at the time of hitting, and have excellent flight performance, that is, high launch angle and long flight distance when hit by a driver and an iron club, compared with the golf balls of Comparative Examples 1 to 6.

On the other hand, in the golf ball of Comparative Example 1, the launch angle is small, which reduces the flight distance, because the thickness of the intermediate layer is large. In addition, the shot feel is slightly hard and poor, because the hardness of the intermediate layer is high.

In the golf ball of Comparative Example 2, the launch angle is the same as that of the golf ball of Examples, but the spin amount is large and the deformation amount is very large, and the rebound characteristics are degraded, which reduces the flight distance. In addition, the shot feel is heavy and poor.

In the golf ball of Comparative Example 3, the specific gravity of the center is large, and the rebound characteristics are degraded, because the specific gravity of the intermediate layer is small and the specific gravity difference from the center is small.

In the golf balls of Comparative Examples 4 to 6, the launch angle is small and rebound characteristics are poor, because the intermediate layer is formed from resin component, compared with the golf ball of Examples having rubber layer.

In the golf ball of Comparative Example 4, the launch angle is small, which reduces the flight distance, because the thickness of the intermediate layer is large. The rebound characteristics are poor, because the hardness of the intermediate layer is low. In addition, the specific gravity of the center is large, and the rebound characteristics are degraded, because the specific gravity of the intermediate layer is small and the specific gravity difference from the center is small.

In the golf ball of Comparative Example 5, the launch angle is small, which reduces the flight distance, because the thickness of the intermediate layer is large. The deformation amount is small, and the'shot feel is hard and poor, because the hardness of the intermediate layer is high. In addition, the specific gravity of the center is large, and the rebound characteristics are degraded, because the specific gravity of the intermediate layer is small and the specific gravity difference from the center is small.

In the golf ball of Comparative Example 6, the launch angle is small, which reduces the flight distance, because the thickness of the intermediate layer is large. In addition, the specific gravity of the center is large, and the rebound characteristics are degraded, because the specific gravity of the intermediate layer is small and the specific gravity difference from the center is small.

What is claimed is:

1. A multi-piece solid golf ball comprising a core consisting of a center and an intermediate layer formed on the center, and a cover covering the core, wherein the intermediate layer (a) is formed from a rubber composition comprising a base rubber, a co-crosslinking agent, an organic peroxide and a filler, (b) has a hardness in JIS-C hardness of 75 to 90, and the hardness of the intermediate layer is higher than a surface hardness in JIS-C hardness of the center by 1 to 12, (c) has a thickness of 0.2 to 1.3 mm, and (d) has a specific gravity of 1.20 to 1.60.

2. The multi-piece solid golf ball according to claim 1, wherein the cover has a thickness of 1.0 to 3.0 mm and a Shore D hardness of 58 to 75.

3. The multi-piece solid golf ball according to claim 1, wherein the intermediate layer has a specific gravity of 1.25 to 1.50, and the specific gravity of the intermediate layer is higher than that of the center by 0.1 to 0.4.

4. The multi-piece solid golf ball according to claim 1, wherein the intermediate layer has a thickness of 0.2 to 0.9 mm.

5. The multi-piece solid golf ball according to claim 1 wherein the intermediate layer has a specific gravity of 1.30 to 1.42.

6. The multi-piece solid golf ball according to claim 1 wherein the intermediate layer has a JIS C hardness of 78 to 90.

* * * * *